US009989870B2

(12) United States Patent
Hashimoto

(10) Patent No.: US 9,989,870 B2
(45) Date of Patent: Jun. 5, 2018

(54) IMAGE FORMATION APPARATUS, TRANSPARENT DEVELOPER AND DEVELOPER CARTRIDGE

(71) Applicant: Oki Data Corporation, Tokyo (JP)

(72) Inventor: Yoshihiro Hashimoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 166 days.

(21) Appl. No.: 14/497,479

(22) Filed: Sep. 26, 2014

(65) Prior Publication Data

US 2015/0093697 A1 Apr. 2, 2015

(30) Foreign Application Priority Data

Sep. 27, 2013 (JP) ..... 2013-201099

(51) Int. Cl.
*G03G 9/087* (2006.01)
*G03G 9/08* (2006.01)

(52) U.S. Cl.
CPC ..... *G03G 9/08755* (2013.01); *G03G 9/0804* (2013.01); *G03G 9/0821* (2013.01); *G03G 9/08782* (2013.01); *G03G 9/08795* (2013.01)

(58) Field of Classification Search
CPC ..... G03G 15/0126; G03G 9/08755; G03G 9/08782
See application file for complete search history.

(56) References Cited

U.S. PATENT DOCUMENTS

2005/0135851 A1* 6/2005 Ng ..... G03G 15/2003 399/341
2010/0183966 A1* 7/2010 Kadokura ..... G03G 9/0819 430/107.1
2012/0107004 A1* 5/2012 Sonohara ..... G03G 15/6585 399/69

FOREIGN PATENT DOCUMENTS

| | | | |
|---|---|---|---|
| JP | H08-146655 | A | 6/1996 |
| JP | 2001-305816 | A | 11/2001 |
| JP | 2003-084524 | A | 3/2003 |
| JP | 2004-163854 | A | 6/2004 |
| JP | 2004-341242 | A | 12/2004 |
| JP | 2010-250055 | A | 11/2010 |
| JP | 2011-100106 | A | 5/2011 |
| JP | 2011-158491 | A | 8/2011 |

* cited by examiner

*Primary Examiner* — Thorl Chea
(74) *Attorney, Agent, or Firm* — Metrolexis Law Group, PLLC

(57) ABSTRACT

An image formation apparatus includes a first development device configured to form a color developer image with a color developer, and a second development device configured to form a transparent developer image with a transparent developer. The ratio of the viscosity of the transparent developer to the viscosity of the color developer is not greater than a certain amount.

8 Claims, 4 Drawing Sheets

IMAGE FORMATION APPARATUS, TRANSPARENT DEVELOPER AND DEVELOPER CARTRIDGE

CROSS REFERENCE TO RELATED APPLICATIONS

This application claims priority based on 35 USC 119 from prior Japanese Patent Application No. 2013-201099 filed on Sep. 27, 2013, entitled "IMAGE FORMATION APPARATUS, TRANSPARENT DEVELOPER AND DEVELOPER CARTRIDGE", the entire contents of which are incorporated herein by reference.

BACKGROUND OF THE INVENTION

1. Field of the Invention

This disclosure relates to an image formation apparatus, a transparent developer and a developer cartridge.

2. Description of Related Art

Besides yellow (Y), magenta (M), cyan (C) and black (K) color toners, a transparent toner has been under study as a developer for giving a gloss finish to a printed image (for example, Japanese Patent Application Publications Nos. 2010-250055 and 2011-100106). Japanese Patent Application Publication No. 2011-100106 discloses that: a transparent toner image is formed on parts of color toner images formed on a record medium; and thereby an image is obtained with a high gloss on only the parts covered with the transparent toner.

SUMMARY OF THE INVENTION

To form an image with gloss contrast by use of color developers and a transparent developer, careful examination needs to be given to the characteristics of the color developers and the characteristics of the transparent developer in order to obtain excellent gloss contrast.

An object of an embodiment of the invention is to provide an image formation apparatus, a transparent developer and a developer cartridge which ensure excellent gloss contrast.

A first aspect of the invention is an image formation apparatus that includes: a first development device configured to form a color developer image with a color developer; and a second development device configured to form a transparent developer image with a transparent developer. A ratio of viscosity of the transparent developer to viscosity of the color developer is not greater than 0.41.

A second aspect of the invention is a transparent developer to be used for an image formation apparatus that includes: a first development device configured to forma color developer image with a color developer; and a second development device configured to form a transparent developer image with the transparent developer. A ratio of viscosity of the transparent developer to viscosity of the color developer is not greater than 0.41.

A third aspect of the invention is a developer cartridge that includes a container containing therein the transparent developer according to the second aspect.

According to the aspect(s) of the invention, it is possible to obtain excellent gloss contrast when an image with gloss contrast is formed by use of the color developer and the transparent developer.

DETAILED DESCRIPTION OF EMBODIMENTS

Figure 1:
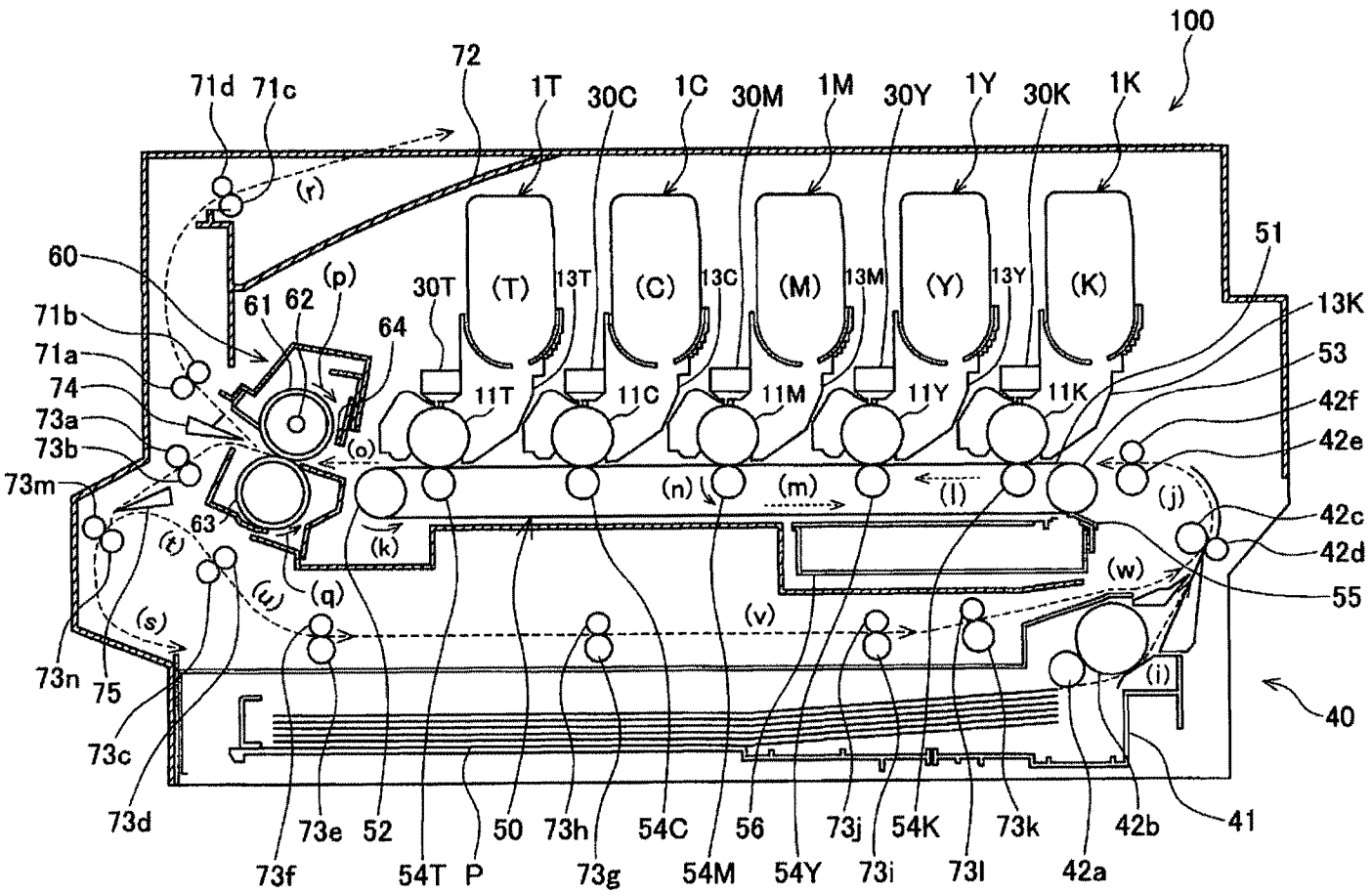
FIG. 1 is a schematic diagram illustrating an example of a configuration of an image formation apparatus of an embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Referring to the drawings, descriptions are hereinbelow provided for an embodiment of the invention. FIG. 1 is a schematic diagram illustrating an example of a configuration of image formation apparatus 100 of the embodiment. Image formation apparatus 100 is configured to form an image with gloss contrast by use of color developers, which are developers with colors, and a transparent developer, which is a developer without a color. In one aspect, image formation apparatus 100 forms an image with gloss contrast on the same record medium. For example, image formation apparatus 100 forms an image region with a lower gloss and an image region with a higher gloss on the same record medium. In another aspect, image formation apparatus 100 forms images with different glosses between different record media. For example, image formation apparatus 100 forms an image with a lower gloss on one record medium, and an image with a higher gloss on another record medium.

Image formation apparatus 100 includes: first development devices configured to form color developer images by use of the color developers, respectively; and a second development device configured to form a transparent developer image by use of the transparent developer. Using the first and second development devices, image formation apparatus 100 forms the color developer images on a record medium, and selectively forms the transparent developer image on the color developer images. Using a fixing device, image formation apparatus 100 subsequently fixes the color and transparent developer images onto the record medium. Thereby, on the record medium, an image region where both the color and transparent developer images are formed has a higher gloss than the other image region where the color developer images are formed but the transparent developer image is not. Thus, it is possible to obtain an image with gloss contrast.

In the embodiment, image formation apparatus 100 is an electrophotographic printer which is capable of color printing. Image formation apparatus 100 forms a color image on sheet P as the record medium by using black (K), yellow (Y), magenta (M) and cyan (c) toners as the color developers, as well as a clear toner as the transparent developer.

In FIG. 1, image formation apparatus 100 includes: image formation sections 1K, 1Y, 1M, 1C, 1T; LED heads 30K, 30Y, 30M, 30C, 30T as exposure devices; medium feeder section 40; transfer section 50; and fixation section 60.

Image formation sections 1K, 1Y, 1M, 1C form color toner images as the color developer images in black, yellow, magenta and cyan, respectively. Image formation sections 1K, 1Y, 1M, 1C include: photosensitive drums 11K, 11Y, 11M, 11C as image carriers on which latent images are formed; and development devices 13K, 13Y, 13M, 13C as first development devices configured to form the color toner images by developing the latent images, formed on the photosensitive drums, with the color developers, respectively. Image formation section 11 forms a clear toner image as the transparent developer image. Image formation section 1T includes: photosensitive drum 11T as an image carrier on which a latent image is formed; and development device 13T as a second development device configured to form the clear toner image by developing the latent image, formed on the photosensitive drum, with the clear toner. Image formation sections 1K, 1Y, 1M, 1C, 1T are arranged in this order in a sheet conveyance direction. The image formation sections are detachably installed in the main body of image formation apparatus 100.

LED heads 30K, 30Y, 30M, 30C, 30T form electrostatic latent images by exposing the surfaces of photosensitive drums 11K, 11Y, 11M, 11C, 11T, respectively. The LED heads are placed opposite the corresponding photosensitive drums. Each LED head is, for example, formed from: a light emitting diode (LED) element; and a lens array configured to focus light emitted from the LED element on the surface of the corresponding photosensitive drum.

Medium feeder section 40 feeds sheets P, as record media, to image formation sections 1K, 1Y, 1M, 1C, 1T. Medium feeder section 40 includes: sheet cassette 41 configured to contain sheets P; sheet conveyance rollers 42*a*, 42*b* configured to feed sheets P separately from sheet cassette 41 on a one-by-one basis; and sheet conveyance rollers 42*c* to 42*f* configured to convey sheets P to the image formation sections while adjusting for skewed feeding of sheets P.

Transfer section 50 transfers toner images, which are formed by image formation sections 1K, 1Y, 1M, 1C, 1T, onto sheet P supplied from medium feeder section 40. Transfer section 50 includes: transfer belt 51 as a medium conveyance member; drive roller 52; tension roller 53; and transfer rollers 54K, 54Y, 54M, 54C, 54T as transfer members. Transfer belt 51 is an endless member configured to hold and convey sheet P supplied from medium feeder section 40. Drive roller 52 drives transfer belt 51. Transfer belt 51 is stretched between tension roller 53 and drive roller 52. Transfer rollers 54K, 54Y, 54M, 54C, 54T are disposed opposite photosensitive drums 11K, 11Y, 11M, 11C, 11T with transfer belt 51 interposed in-between, and transfer their respective toner images, formed on the corresponding photosensitive drums, onto sheet P on transfer belt 51. Transfer section 50 further includes: transfer belt cleaning blade 55 configured to remove toners attached to transfer belt 51; and toner box 56 configured to contain the toners removed by transfer belt cleaning blade 55.

Fixation section 60 is disposed downstream of transfer section 50 in the sheet conveyance direction, and fixes the toner images transferred onto sheet P. Fixation section 60 includes: fixing roller 61; heater 62 configured to heat fixing roller 61; pressure roller 63 coming into pressure contact with fixing roller 61; and temperature sensor 64, such as a thermistor, configured to detect the temperature on the surface of fixing roller 61. Sheet conveyance rollers 71*a* to 71*d* are configured to convey and discharge sheet P, which passes through fixation section 60, onto stacker 72 that is disposed downstream of fixation section 60 in the sheet conveyance direction. Furthermore, as a configuration for double-sided printing, sheet conveyance rollers 73*a* to 73*n* and conveyance passage switcher guides 74, 75 are also disposed downstream of fixation section 60.

Figure 2:
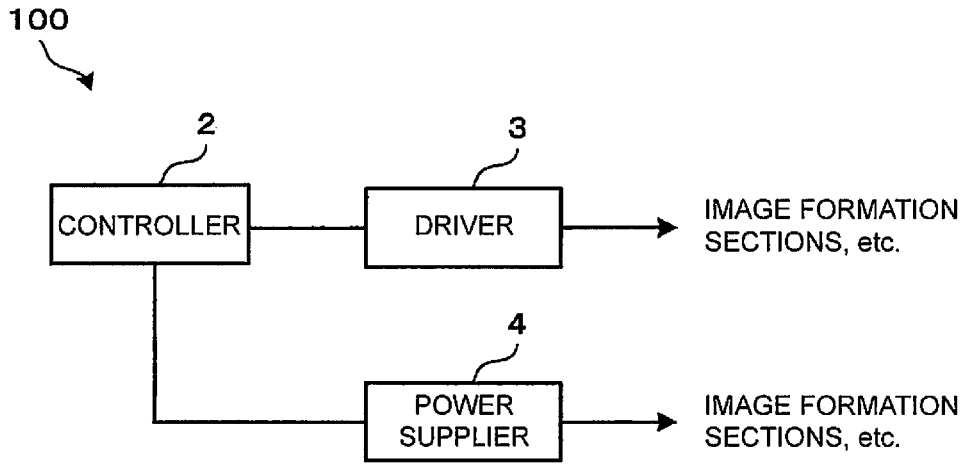
FIG. 2 is a block diagram illustrating a configuration of a control system in the image formation apparatus.

As illustrated in FIG. 2, image formation apparatus 100 further includes controller 2, driver 3 and power supplier 4. Controller 2 includes, for example, a central processing unit (CPU), and controls the operation of image formation apparatus 100. Driver 3 includes a motor, for example. Under instructions from controller 2, driver 3 supplies a driving force to the components of image formation apparatus 100, such as to image formation sections 1K, 1Y, 1M, 1C, 1T, medium feeder section 40, transfer section 50, and fixation section 60. Under instructions from controller 2, power supplier 4 supplies voltages or electric power to the components of image formation apparatus 100, such as to image formation sections 1K, 1Y, 1M, 1C, 1T, transfer section 50, and fixation section 60.

Under print instructions from a host apparatus (not illustrated), a user or the like, controller 2 makes image formation sections 1K, 1Y, 1M, 1C form the respective color toner images on sheet P, and makes image formation section 1T form a clear toner image on specific areas of the color toner images on sheet P, as well as makes fixation section 60 fix the color toner images and the clear toner image which are formed on sheet P. In this event, controller 2 causes the clear toner image to be formed in areas specified by the print instructions, or in areas specified by information on the transparent images included in the print instructions, for example. Through the print instructions, the user can specify arbitrary areas to which the user wishes to give a gloss finish.

Figure 3:
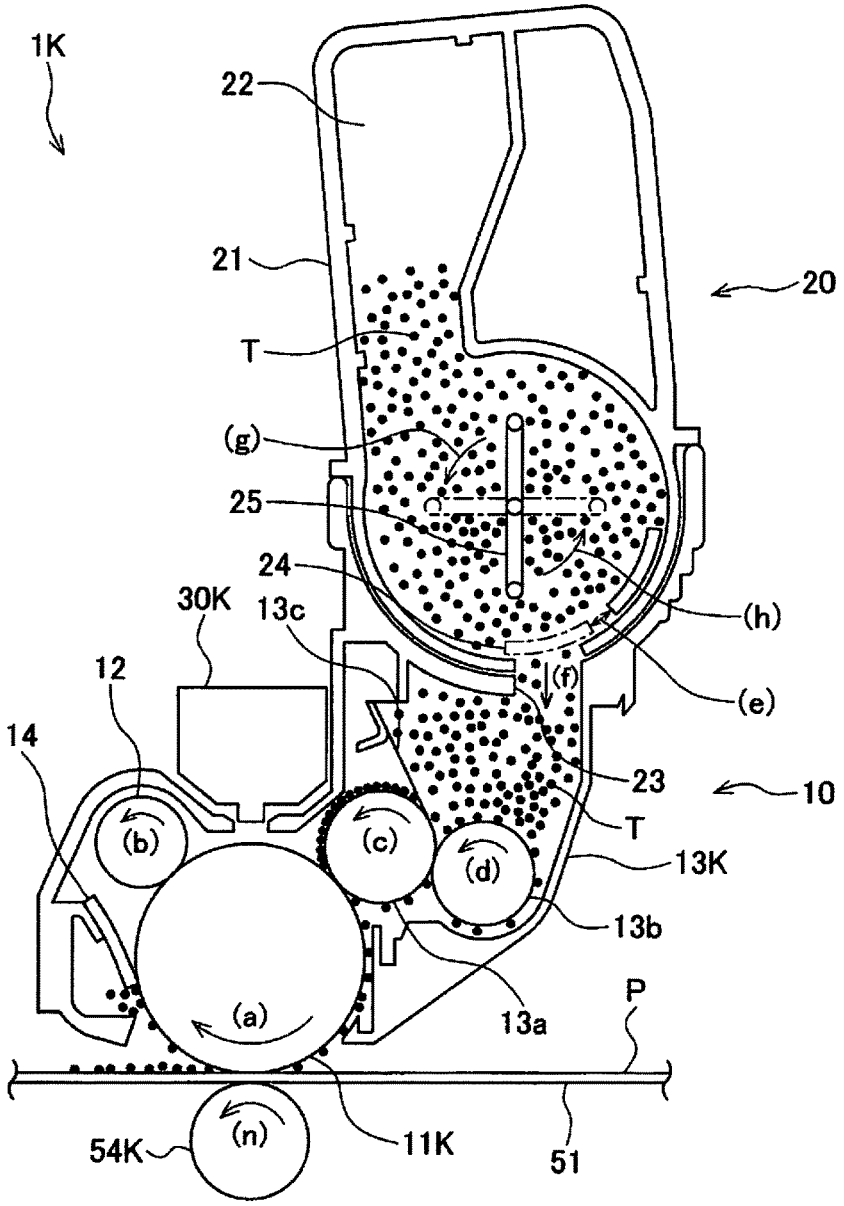
FIG. 3 is a schematic diagram illustrating a configuration of an image formation section in the image formation apparatus.

FIG. 3 is a schematic diagram illustrating a configuration of image formation section 1K. Referring to FIG. 3, descriptions are hereinbelow provided for image formation section 1K. It should be noted that, except for the toner colors, image formation sections 1Y, 1M, 1C and 1T have the same configuration as image formation section 1K has. For this reason, descriptions for image formation sections 1Y, 1M, 1C, 1T are omitted.

Image formation section 1K includes: image formation unit 10; and toner cartridge 20 as a developer container. Image formation unit 10 is a unit configured to form a toner image by use of a toner. Toner cartridge 20 is a container configured to contain the toner. Toner cartridge 20 is detachably attached to image formation unit 10.

Image formation unit 10 includes: photosensitive drum 11K; charge roller 12 as a charging device; development device 13K; and cleaning device 14.

Photosensitive drum 11K is a member configured to bear the toner image. Photosensitive drum 11K is, for example, an organic photoreceptor having a configuration in which a charge generating layer as a photo-conduction layer, and a charge transport layer are stacked on an aluminum pipe as a conductive support in this order. Photosensitive drum 11K rotates in an arrow (a) direction in the drawing. Charge roller 12, LED head 30K, development device 13K, transfer roller 54K and cleaning device 14 are disposed around photosensitive drum 11K in this order in the rotational direction of photosensitive drum 11K.

Charge roller 12 evenly charges the surface of photosensitive drum 11K. Charge roller 12 is disposed in contact with the surface of photosensitive drum 11K, and rotates in an arrow (b) direction in the drawing. Charge roller 12 is formed, for example, from: a metal shaft; and a semiconductive rubber layer formed around the metal shaft. LED head 30K forms an electrostatic latent image on the surface of photosensitive drum 11K which is charged by charge roller 12.

Development device 13K forms the toner image by developing the electrostatic latent image, which is formed on photosensitive drum 11K, with toner T. Development device 13K includes: development roller 13*a* as a developer carrier configured to supply toner T to the electrostatic latent image while holding toner T; toner supply roller 13*b* as a developer supply member configured to supply toner T to development roller 13*a*; and development blade 13*c* as a developer regulation member configured to form toner T, which is supplied onto development roller 13*a*, into a thin even layer. Development roller 13*a* is disposed in contact with the surface of photosensitive drum 11K, and rotates in an arrow (c) direction in the drawing. Development roller 13*a* is formed, for example, from: a metal shaft; and a semiconductive urethane rubber layer formed around the metal shaft. Toner supply roller 13*b* is disposed in contact with the surface of development roller 13*a*, and rotates in an arrow (d) direction in the drawing. Toner supply roller 13*b* is formed, for example, from: a metal shaft; and a semiconductive silicone foam sponge layer formed around the metal shaft. Development blade 13*c* is disposed in contact with the surface of development roller 13*a*, and is formed from a plate-shaped member of stainless steel, for example. The toner image formed on photosensitive drum 11K by development device 13K is transferred by transfer roller 54K onto sheet P.

Cleaning device 14 is a device configured to clean photosensitive drum 11K, and removes toner T which remains on the surface of photosensitive drum 11K after the toner image transfer. Cleaning device 14 includes, for example, a cleaning blade made of urethane rubber or the like, and is configured to be brought into press contact with the surface of photosensitive drum 11K.

Toner cartridge 20 includes container 21. Container 21 includes container portion 22 which is an internal space thereof to contain toner T. Discharge port 23 is configured to discharge toner T, which is contained in container portion 22, to the outside and is formed in the lower portion of container 21. Shutter 24 is configured to open and close discharge port 23 and is disposed below container portion 22. Shutter 24 moves with respect to container 21 in the arrow (e) directions in the drawing when, for example, a lever member fixed to shutter 24 is operated. Thereby, discharge port 23 is opened and closed. Before toner cartridge 20 is attached to image formation unit 10, shutter 24 is situated in a position (a position indicated with a chain line) for closing discharge port 23. After toner cartridge 20 is attached to image formation unit 10, shutter 24 is moved to a position (a position indicated with a solid line) for opening discharge port 23 through the operation of the lever member, and the like. Thereby, toner T contained in container portion 22 falls from discharge port 23 in an arrow (f) direction in the drawing, and is supplied to image formation unit 10. Toner cartridge 20 further includes agitation bar 25 which is a stirring member configured to stir toner T which is contained in container portion 22. Agitation bar 25 is disposed inside container portion 22, and rotates in arrow (g) and (h) directions in the drawing.

Next, descriptions are provided for the toners of the embodiment. The clear toner includes a binder resin. A polyester resin, for example, is used as the binder resin (or as a base material). The clear toner may include a release agent. Paraffin wax, for example, is used as the release agent. The cleaner toner is made by a dissolution suspension method, for example. In the dissolution suspension method, an oil phase in which toner components including the binder resin and the release agent are dissolved or dispersed in an organic solvent, is dispersed into an aqueous phase in which an inorganic dispersant is dispersed; and thereby toner particles are produced. In this method, it is likely that inorganic fine particles are taken into the toner in the toner production process, and accordingly, the toner becomes hygroscopic, and its storability is degraded. With this taken into consideration, one mode suitable to enhance the storability of the toner by preventing inorganic fine particles from being taken into the toner uses polyester resin modified with a long chain alkyl group, which is expressed by the following chemical formula (1), as the binder resin to be included in the toner. The color toners may be produced with the same production method as the one used for production of the clear toner, or with a different production method therefrom. Each color toner includes the binder resin, the corresponding colorant and the release agent, for example.

[Chemical Formula 1]

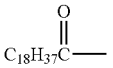

(1)

Next, referring to FIGS. 1 to 3, descriptions are provided for the print operation of image formation apparatus 100. In FIG. 2, once receiving the print instructions from the host apparatus (not illustrated), the user or the like, controller 2 controls driver 3, and thereby rotates the photosensitive drums, development rollers 13*a*, drive roller 52, the rollers in fixation section 60, the sheet conveyance rollers, and the like. Furthermore, controller 2 controls power supplier 4, and thereby applies predetermined voltages to charge rollers 12, development rollers 13*a*, toner supply rollers 13*b*, development blades 13*c*, the transfer rollers, and the like, respectively. Moreover, controller 2 drives the color LED heads for the respective colors on the basis of information on the color images in the respective colors included in the print instructions. In addition, controller 2 controls power supplier 4, and thereby supplies electric power to fixation section 60. In this event, on the basis of the temperatures detected by temperature sensor 64, controller 2 controls the electric power to be supplied to heater 62 so that the temperature of the surface of the fixation roller 61 becomes equal to a predetermined fixation temperature. Through these controls, the following print operation is carried out.

In FIG. 1, in image formation sections 1K, 1Y, 1M, 1C, 1T, the corresponding color toner images are formed on photosensitive drums 11K, 11Y, 11M, 11C, 11T. On the other hand, sheet P is fed by sheet conveyance rollers 42*a*, 42*b* from sheet cassette 41 in an arrow (i) direction in the drawing, and thereafter is conveyed by sheet conveyance rollers 42*c* to 42*f* in an arrow (j) direction in the drawing, and thereby is supplied to transfer section 50. In transfer section 50, drive roller 52 rotates in an arrow (k) direction in the drawing; transfer belt 51 rotates in arrow (l) and (m) directions in the drawing; and transfer rollers 54K, 54Y, 54M, 54C, 54T rotate in an arrow (n) direction in the drawing, in response to the rotation of transfer belt 51. The image formation section-side surface of transfer belt 51 runs in the arrow (l) direction. Sheet P supplied from sheet conveyance rollers 42*c* to 42*f* is conveyed in the arrow (l) direction while held on transfer belt 51, and is sequentially passed through photosensitive drums 11K, 11Y, 11M, 11C, 11T. During the passage, the color toner images formed on the photosensitive drums are transferred by the transfer rollers onto sheet P in the order of black, yellow, magenta, cyan and clear colors. In other words, the toner images formed by the image formation sections are formed on sheet P conveyed from medium feeder section 40 in a way that the toner images are stacked one after another from upstream in the sheet conveyance direction. Sheet P on which the toner images are formed is conveyed by transfer belt 51 in an arrow (o) direction in the drawing, and is sent to fixation section 60. In fixation section 60, fixation roller 61 rotates in an arrow (p) direction in the drawing; pressure roller 63 rotates in an arrow (q) direction in the drawing; and fixation roller 61 and pressure roller 63 convey sheet P from transfer section 50 while holding sheet P inbetween. During the conveyance, the toner images formed on sheet P are heated and pressed by contact portions of fixation roller 61 and pressure roller 63, and thus are fixed onto sheet P. Thereby, the color image is formed on sheet P. After being passed through fixation section 60, sheet P is conveyed by sheet conveyance rollers 71*a* to 71*d* in an arrow (r) direction in the drawing, and is delivered onto stacker 72. In a case of double-sided printing, after being passing through fixation section 60, sheet P is conveyed in the following manner. Sheet conveyance rollers 73*a* to 73*n* and conveyance passage switcher guides 74, 75 convey sheet P in an arrow (s) direction in the drawing, stop sheet P, and thereafter convey sheet P in arrow (t), (u), (v) and (w) directions, and send sheet P to transfer section 50 once again.

During the above-described print operation, image formation section 1K forms the toner image as follows. Since the operations of image formation sections 1Y, 1M, 1C, 1T are the same as that of image formation section 1K, descriptions for image formation sections 1Y, 1M, 1C, 1T are omitted.

In FIG. 3, photosensitive drum 11K rotates in the arrow (a) direction in the drawing. The surface of photosensitive drum 11K is evenly charged by charge roller 12. LED head 30K casts light in accordance with the image information onto the charged surface of photosensitive drum 11K. Thereby, an electrostatic latent image is formed in accordance with the image information. In development device 13K, toner T supplied from toner cartridge 20 is supplied by toner supply roller 13*b* to development roller 13*a*, and toner T supplied to development roller 13*a* is spread in an even thickness by development blade 13*c*. The electrostatic latent image formed on photosensitive drum 11K is developed with toner T in the even thickness on development roller 13*a*. Thereby, the toner image is formed on photosensitive drum 11K. The toner image formed on photosensitive drum 11K is electrically transferred by transfer roller 54K onto sheet P. Residual toner remaining on the surface of photosensitive drum 11K is removed by cleaning device 14.

Figure 4:
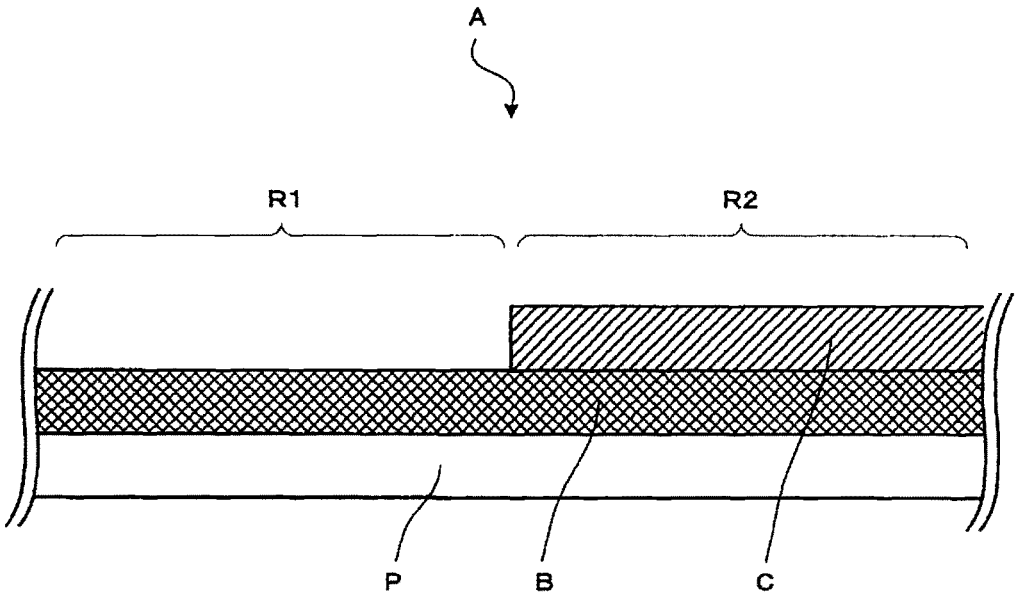
FIG. 4 is a schematic cross-sectional view illustrating a toner image which is transferred onto sheet P by the image formation apparatus.

FIG. 4 is a schematic cross-sectional view illustrating toner image A transferred onto sheet P. As illustrated in FIG. 4, color toner image B using at least one of the black, yellow, magenta and cyan toners is formed on sheet P, and clear toner image C using the clear toner is formed on color toner image B. In FIG. 4, clear toner image C is formed on part of color toner image B. For this reason, sheet P includes: image region (hereinafter referred to as "color toner region") R1 where color toner image B is formed on sheet P but no clear toner image C is formed on color toner image B; and image region (hereinafter referred to as "clear toner region") R2 where color toner image B is formed on sheet P and clear toner image C is formed on color toner image B.

Toner image A transferred onto sheet P is fixed by fixation section 60. In the embodiment, the fixation temperature is set at 160° C.±10° C., whereby the temperature applied to toner image A is approximately 120° C. An air space exists between the surface of fixation roller 61 and sheet P. This air space serves as resistance of heat transfer. As a result, the temperature which the toner receives is lower than 160° C., and is approximately 120° C. With this taken into consideration, the viscosity of each toner at 120° C. is measured in the following examples.

In this respect, for each toner, a lower viscosity makes the smoothness of the surface of the fixed toner image become higher, and makes a gloss level become accordingly higher. With this taken into consideration, in the embodiment, the viscosity of the clear toner is set sufficiently lower than the viscosity of each color toner. To put it concretely, a ratio (v2/v1) of the viscosity v2 of the clear toner to the viscosity v1 of the color toner, namely a viscosity ratio of the clear toner to the color toner, is set at a predetermined value or less. Thereby, the surface of fixed clear toner region R2 acquires a higher smoothness, a higher gloss level and a better gloss contrast than the surface of fixed color toner region R1.

To put it in detail, if a predetermined amount of heat is added by fixation section 60 to toner image A where, for example, the viscosity of the clear toner is almost equal to the viscosity of the color toner, the surface of fixed clear toner region R1 and the surface of fixed color toner region R2 have almost the same smoothness and gloss level because the time needed for the clear toner to completely melt and the time needed for the color toner to completely melt are almost equal to each other. In this case, for example, diffused reflection makes the surface of fixed clear toner region R2 look clouded because of the lower smoothness of the surface. Accordingly, the surface of fixed clear toner region R2 acquires no high gloss.

In contrast to this, when the predetermined amount of heat is added by fixation section 60 to toner image A where, like in the embodiment, the viscosity of the clear toner is set lower than the viscosity of the color toner, the surface of fixed clear toner region R2 acquires a higher smoothness and a higher gloss level than the surface of fixed color toner region R1 since the clear toner completely melts earlier than the color toner. In this case, for example, the surface of fixed clear toner region R2 shows a stronger regular reflection because of the higher smoothness of the surface. Accordingly, the surface of fixed clear toner region R2 acquires a higher gloss.

The viscosity of each toner can be changed by controlling the glass transition temperature Tg or melting temperature T1/2 of the binder resin. In this respect, it is desirable that the viscosity of the toner be changed by controlling the melting temperature T1/2 of the binder resin. When the melting temperature T1/2 is raised, the viscosity can be set higher. When the melting temperature T1/2 is decreased, the viscosity can be set lower. T1/2 denotes the melting temperature determined using the bisection method. In the following explanation, the glass transition temperature Tg is referred to simply as "Tg," and the melting temperature T1/2 is referred to simply as "T1/2."

It should be noted that when clear toner regions R2 are formed using the same clear toner, the surfaces of fixed clear toner regions R2 have almost the same gloss level no matter how different the toner color or type is among color toner images B formed under clear toner images C in clear toner regions R2. In other words, the gloss level of the surface of each fixed clear toner region R2 depends little on the toner color or type of color toner image B under clear toner image C therein. Furthermore, when the molecular weight distribution of the binder resin is constant, the viscosity of each toner at the predetermined temperature (for example, 120° C.) becomes lower as the melting start temperature of the toner becomes lower. Accordingly, the smoothness of the surface of the toner image after the fixation becomes higher.

For this reason, for the purpose of making the viscosity of the clear toner lower than those of the color toners, the melting start temperature of the clear toner may be set lower than those of the color toners. The melting start temperatures of the toners can be measured, for example, by use of a flow tester, which is described later. Moreover, in a printed matter having color toner regions and clear toner regions, for example, glosses in the clear toner regions can be made to stand out by obtaining higher gloss contrast.

Next, Example 1 and Comparative Examples 1 to 3 are discussed.

Example 1

In Example 1, a clear toner is produced by use of the following production method. First of all, in the step of obtaining an aqueous medium in which an inorganic dispersant is dispersed, 1110 weight parts of industrial trisodium phosphate dodecahydrate is mixed with 37680 weight parts of purified water, and dissolved at a solution temperature of 60° C., followed by adding dilute nitric acid as a pH adjuster. Furthermore, a calcium chloride aqueous solution prepared by dissolving 540 weight parts of industrial calcium chloride anhydride in 4360 weight parts of purified water is added to the resultant solution, followed by high-speed agitation using a Neomixer (Registered Trademark) (manufactured by Primix Corporation) at a revolution speed of 4300 revolutions per minute for 34 minutes while keeping the solution temperature at 60° C. Thereby, the aqueous phase including the dispersant is prepared.

On the other hand, 5300 weight parts of ethyl acetate is heated and agitated at a solution temperature 50° C., and 56 weight parts of paraffin wax (PARACOHOL-6150, manufactured by Nippon Seiro Co., Ltd., whose melting point is 67° C.) is added to the resultant ethyl acetate. The solubility of this wax in ethyl acetate is better than the solubility of regular paraffin wax in ethyl acetate, and the wax completely dissolves into the ethyl acetate in several minutes after its addition. After the dissolution of the wax, 1090 weight parts of polyester resin with parameters of Tg at 68° C. and T1/2 at 115° C., and with its hydrophobicity being increased by modifying the resin with a long chain alkyl group which has the structure expressed by Chemical Formula (1) given above, is added thereto and agitated until all solids disappear. Thereby, the oil phase is prepared. Tg of the polyester resin is measured using a differential scanning calorimeter (DSC6220, manufactured by SII Nano Technology Inc.), and T1/2 of the polyester resin is measured using a flow tester (CFT-500D, manufactured by Shimadzu Corporation).

With the solution temperature of the aqueous phase kept at 60° C., the oil phase is added to the aqueous phase, and is suspended by high-speed agitation for 10 minutes using the Neomixer (manufactured by Primix Corporation) at a revolution speed of 1700 revolutions per minute. Thereby, particles are produced. Thereafter, the ethyl acetate is removed by vacuum distillation.

The particles in the solution are once dehydrated. Thereafter, the resultant particles are re-dispersed into purified water, followed by: adding nitric acid to reduce the pH to 1.5 or less; agitating; acid rinsing; and dissolving tricalcium phosphate as a suspension stabilizer. Subsequently, acid rinsing is similarly performed once again. Furthermore, the dehydrated particles are re-dispersed into purified water, agitated, and rinsed with water. After that, dehydration and drying are performed. Thereby, the toner base particles are produced.

Next, in an external addition step, 1.0 weight part of hydrophobic silica RX50 (manufactured by Nippon Aerosil Co., Ltd., whose average primary particle size is 40 nanometers) and 0.8 weight part of hydrophobic silica RX200 (manufactured by Nippon Aerosil Co., Ltd., whose average primary particle size is 12 nanometers) are added to 100 weight parts of toner base particles thus produced, followed by agitation for 10 minutes using a Henschel mixer with a 10-liter capacity at a revolution speed of 5400 revolutions per minute. Thereby, the clear toner is obtained.

Tg of the clear toner of the embodiment is measured to be 67° C. In addition, the viscoelasticity of the clear toner of the embodiment is measured. The viscosity of the clear toner is 982 Pa·s. Furthermore, the viscoelasticity of each color toner of the embodiment to be used for the print quality evaluation is measured. The viscosity of the yellow toner is 3504 Pa·s; the viscosity of the magenta toner is 3962 Pa·s; the viscosity of the cyan toner is 2422 Pa·s; and the viscosity of the black toner is 3650 Pa·s. Accordingly, the viscosity ratio of the clear toner to each color toner is as follows:

(viscosity of clear toner/viscosity of yellow toner)≈0.28,
(viscosity of clear toner/viscosity of magenta toner)≈0.25,
(viscosity of clear toner/viscosity of cyan toner)≈0.41, and
(viscosity of clear toner/viscosity of black toner)≈0.27.

It should be noted that: Tg of the clear toner is measured by use of the differential scanning calorimeter model DSC6220; and the viscoelasticity of each of the clear and color toners is measured by use of a rheometer (VAR-100AD, manufactured by Reologica Instruments, Inc.). Furthermore, the measured viscosity of each of the clear and color toners is that at 120° C., and the viscosity ratios are those at 120° C. as well. The same conditions apply to Examples 2 to 4 and Comparative Examples 1 to 6.

Using the above-described clear and color toners, a gloss evaluation is performed on printed images produced by the image formation apparatus of the embodiment. For this gloss evaluation, a printed image is obtained by transferring a 100-percent-duty solid image of the yellow toner onto a sheet; and transferring a 100-percent-duty solid image of the clear toner to be stacked onto part of the region of the solid image of the yellow toner. For this printed image, the gloss level of a part printed with the clear and yellow toners, and the gloss level of the other part printed with the yellow toner alone but not the clear toner are measured. Thereby, the difference between the gloss levels of the two parts is figured out as the gloss contrast. The gloss levels are measured by use of a gloss meter (GM-26D, manufactured by Murakami Color Research Laboratory Co., Ltd.). For each of the printed images respectively using the magenta, cyan and black toners, the gloss level of a part printed with the clear and corresponding color toners, and the gloss level of the other part printed with only the corresponding color toner but not the clear toner are measured in the same manner as for the printed image using the yellow toner, and thereby, the gloss contrast is figured out. Thereafter, for each of the printed images respectively using the yellow, magenta, cyan and black toners, the level of the gloss contrast is evaluated. A gloss contrast of 15 or more is evaluated as being "excellent" (o). A gloss contrast of not less than 10 but not greater than 14 is evaluated as being "good" (Δ). A gloss contrast of 9 or less is evaluated as being "bad" (x).

In the gloss evaluation for Example 1, the gloss contrasts on the yellow, magenta, cyan and black toner solid images are measured to be 24, 20, 16 and 24, respectively. Therefore for each color toner solid image, the gloss contrast is not less than 15, so the level of the gloss contrast is evaluated as being "excellent," which shows that a print result with an excellent gloss contrast can be obtained.

Comparative Example 1

In Comparative Example 1, a clear toner is produced in the same manner as in Example 1, except that Tg and T1/2 of the used polyester resin are 71° C. and 121° C., respectively. Tg and the viscosity of the clear toner are 70° C. and 2325 Pa·s, respectively. For the print quality evaluation, Comparative Example 1 uses the color toners which have the same viscosity values as the color toners used in Example 1. The viscosity ratio of the clear toner to each color toner is as follows:

(viscosity of clear toner/viscosity of yellow toner)≈0.66,
(viscosity of clear toner/viscosity of magenta toner)≈0.59,
(viscosity of clear toner/viscosity of cyan toner)≈0.96, and
(viscosity of clear toner/viscosity of black toner)≈0.64.

Using the above-described clear and color toners, a gloss evaluation is performed in the same manner as in Example 1. The gloss contrasts on the yellow, magenta, cyan and black toner solid images are measured to be 8, 3, 2 and 8, respectively. Therefore for each color toner solid image, the gloss contrast is not greater than 9, the level of the gloss contrast is evaluated as being "bad," and no apparent gloss contrast can be observed.

Comparative Example 2

In Comparative Example 2, a clear toner is produced in the same manner as in Example 1, except that Tg and T1/2 of the used polyester resin are 71° C. and 124° C., respectively. Tg and the viscosity of the clear toner are 70° C. and 3650 Pa·s, respectively. For the print quality evaluation, Comparative Example 2 uses the color toners which have the same viscosity values as the color toners used in Example 1. The viscosity ratio of the clear toner to each color toner is as follows:

(viscosity of clear toner/viscosity of yellow toner)≈1.04,
(viscosity of clear toner/viscosity of magenta toner)≈0.92,
(viscosity of clear toner/viscosity of cyan toner)≈1.51, and
(viscosity of clear toner/viscosity of black toner)≈1.00.

Using the above-described clear and color toners, a gloss evaluation is performed in the same manner as in Example 1. The gloss contrasts on the yellow, magenta, cyan and black toner solid images measured to be 8, 2, 1 and 8, respectively. Therefore for each color toner solid image, the gloss contrast not greater than 9, so the level of the gloss contrast is evaluated as being "bad," and no apparent gloss contrast can be observed.

Comparative Example 3

In Comparative Example 3, a clear toner is produced in the same manner as in Example 1, except that Tg and T1/2 of the used polyester resin are 71° C. and 126° C., respectively. Tg and the viscosity of the clear toner are 70° C. and 4128 Pa·s, respectively. For the print quality evaluation, Comparative Example 3 uses the color toners which have the same viscosity values as the color toners used in Example 1. The viscosity ratio of the clear toner to each color toner is as follows:

(viscosity of clear toner/viscosity of yellow toner)≈1.18,
(viscosity of clear toner/viscosity of magenta toner)≈1.04,
(viscosity of clear toner/viscosity of cyan toner)≈1.70, and
(viscosity of clear toner/viscosity of black toner)≈1.13.

Using the above-described clear and color toners, a gloss evaluation is performed in the same manner as in Example 1. The gloss contrasts on the yellow, magenta, cyan and black toner solid images are measured to be 7, 2, 1 and 7, respectively. For each color toner solid image, the gloss contrast is not greater than 9, so the level of the gloss contrast is evaluated as being "bad," and no apparent gloss contrast can be observed.

The settings, measurements and evaluation results of Example 1 and Comparative Examples 1 to 3 are shown in Table 1.

TABLE 1

| | Polyester Resin | | Wax | | Clear Toner | | Color Toners | | | |
|---|---|---|---|---|---|---|---|---|---|---|
| | | | | | | CL | Y | M | C | K |
| | | | | Melting | | Viscosity | Viscosity | Viscosity | Viscosity | Viscosity |
| | Tg | T½ | Type | Point | Tg | [Pa · s] | [Pa · s] | [Pa · s] | [Pa · s] | [Pa · s] |
| Example 1 | 68 | 115 | Paraffin | 67 | 67 | 982 | 3504 | 3962 | 2422 | 3650 |
| Comparative Example 1 | 71 | 121 | ↑ | ↑ | 70 | 2325 | ↑ | ↑ | ↑ | ↑ |
| Comparative Example 2 | 71 | 124 | ↑ | ↑ | 70 | 3650 | ↑ | ↑ | ↑ | ↑ |
| Comparative Example 3 | 71 | 126 | ↑ | ↑ | 70 | 4128 | ↑ | ↑ | ↑ | ↑ |

| | Viscosity Ratios | | | | Gloss Contrasts | | | | |
|---|---|---|---|---|---|---|---|---|---|
| | CL/Y | CL/M | CL/C | CL/K | CL-Y | CL-M | CL-C | CL-K | Gloss |
| Example 1 | 0.28 | 0.25 | 0.41 | 0.27 | 24 | 20 | 16 | 24 | ○ |
| Comparative Example 1 | 0.66 | 0.59 | 0.96 | 0.64 | 8 | 3 | 2 | 8 | x |
| Comparative Example 2 | 1.04 | 0.92 | 1.51 | 1.00 | 8 | 2 | 1 | 8 | x |
| Comparative Example 3 | 1.18 | 1.04 | 1.70 | 1.13 | 7 | 2 | 1 | 7 | x |

Next, Examples 2 to 4 and Comparative Examples 4 to 7 are discussed.

Example 2

In Example 2, a clear toner is produced in the same manner as in Example 1, except that paraffin wax (SP-0145, manufactured by Nippon Seiro Co., Ltd., whose melting point is 62° C.) is instead used as the wax. The solubility of this wax in ethyl acetate is also better than the solubility of regular paraffin wax in ethyl acetate, and the wax completely dissolves into the ethyl acetate in several minutes after its addition. The ratio of the weight of the wax to the total of the weight of the polyester resin and the weight of the wax in the clear toner (hereinafter referred to as a "wax weight ratio"), that is, the ratio m2/(m1+m2) of the weight m2 of the wax to the total of the weight m1 of the polyester resin and the weight m2 of the wax, is calculated as 56/(1090+56)×100≈4.9 wt %. Tg and the viscosity of the clear toner are 70° C. and 638 Pa·s, respectively. For the print quality evaluation, Example 2 uses the color toners which have the same viscosity values as the color toners used in Example 1. The viscosity ratio of the clear toner to each color toner at 120° C. is as follows:

(viscosity of clear toner/viscosity of yellow toner)≈0.18,
(viscosity of clear toner/viscosity of magenta toner)≈0.16,
(viscosity of clear toner/viscosity of cyan toner)≈0.26, and
(viscosity of clear toner/viscosity of black toner)≈0.17.

Using the above-described clear and color toners, a gloss evaluation is performed in the same manner as in Example 1. The gloss contrasts on the yellow, magenta, cyan and black toner solid images are measured to be 26, 21, 18 and 28, respectively. For each color toner solid image, the gloss contrast is not less than 15, so the level of the gloss contrast is evaluated as being "excellent," which shows that a print result with an excellent gloss contrast can be obtained.

Furthermore, the fixation quality of the clear toner is evaluated. An LED printer (ML-910PS, manufactured by Oki Data Corporation) is used for the fixation quality evaluation. The purpose of this test is to check whether or not cold offset occurs, and whether or not hot offset occurs, when clear toner images are printed on sheets under varying fixation temperatures. From this, a temperature difference can be found between the upper and lower limits of a fixation temperature range within which neither the cold nor hot offset occurs. In this respect, the cold offset means a phenomenon in which the temperature of the surface of the fixation roller is so low that toner comes off a sheet. The hot offset means a phenomenon in which the temperature of the surface of the fixation roller is so high that roughness occurs on a printed surface. On the basis of the temperature difference thus obtained, the levels of the fixation quality are evaluated as follows. When the temperature difference is 35° C. or more, the level of the fixation quality is evaluated as being "excellent" (o). When the temperature difference is not less than 25° C. but not greater than 34° C., the level of the fixation quality is evaluated as being "good" (Δ). When the temperature difference is not greater than 24° C., the level of the fixation quality is evaluated as being "bad" (x). In this example, the fixation quality evaluation is that: the temperature difference stands at 35° C.; and the level of the fixation quality is "excellent."

Moreover, the storability of the clear toner is evaluated. The storability evaluation is performed this way: a metal-made cylinder with a 30-mm diameter and a 80-mm height is placed on a glass plate; 10 grams of the clear toner is placed inside the cylinder; with a 20-gram weight placed on the clear toner, the clear toner is left in a thermostatic chamber with a 55-percent humidity at a temperature of 50° C. for 48 hours; thereafter, the weight and the cylinder are removed slowly; subsequently, 10-gram weights are placed on the column-shaped pile of the clear toner on a one-by-one basis; and when the column-shaped pile of clear toner collapses, the total weight of the thus-placed weights is measured. It should be noted that if the column-shaped pile of clear toner collapses when the cylinder is removed, the total weight of the weights is deemed to be 0 g. On the basis of the measured total weight of the thus-placed weights, the levels of the storability are evaluated as follows. When the total weight is 60 grams or less, the level of the storability is evaluated as being "excellent" (o). When the total weight is not less than 70 grams but not greater than 150 grams, the level of the storability is evaluated as being "good" (Δ). When the total weight is not less than 160 grams, the level of the storability is evaluated as being "bad" (x). For the embodiment, the storability evaluation shows that the level of the storability is "excellent." It should be noted that, albeit not shown in Table 1, the level of the storability of each of the clear toners of Example 1 and Comparative Examples 1 to 3 is also "excellent."

Example 3

In Example 3, a clear toner is produced in the same manner as in Example 2, except that the amount of paraffin wax to be added is increased to 84 weight parts. The wax weight ratio in the clear toner is calculated as 84/(1090+84)×100≈7.2 wt %. Tg and the viscosity of the clear toner are 70° C. and 617 Pa·s, respectively. For the print quality evaluation, Example 3 uses the color toners which have the same viscosity values as the color toners used in Example 1. The viscosity ratio of the clear toner to each color toner is as follows:

(viscosity of clear toner/viscosity of yellow toner)≈0.18,
(viscosity of clear toner/viscosity of magenta toner)≈0.16,
(viscosity of clear toner/viscosity of cyan toner)≈0.25, and
(viscosity of clear toner/viscosity of black toner)≈0.17.

Using the above-described clear and color toners, a gloss evaluation is performed in the same manner as in Example 1. The gloss contrasts on the yellow, magenta, cyan and black toner solid images are measured to be 27, 22, 19 and 29, respectively. On each color toner, the gloss contrast stands at not less than 15, so the level of the gloss contrast is evaluated as being "excellent," which shows that a print result with an excellent gloss contrast can be obtained.

Furthermore, using the above-described clear toner, the fixation quality is evaluated in the same manner as in Example 2. The temperature difference stands at 40° C., and the level of the fixation quality is evaluated as being "excellent." Moreover, using the above-described clear toner, the storability is evaluated in the same manner as in Example 2. The level of the storability is evaluated as being "excellent."

Example 4

In Example 4, a clear toner is produced in the same manner as in Example 3, except that Tg and T1/2 of the used polyester resin are 62° C. and 101° C., respectively. The wax weight ratio in the clear toner is calculated as 84/(1090+84)×100≈7.2 wt %. Tg and the viscosity of the clear toner are 66° C. and 525 Pa·s, respectively. For the print quality evaluation, Example 4 uses the color toners which have the same viscosity values as the color toners used in Example 1. The viscosity ratio of the clear toner to each color toner is as follows:

(viscosity of clear toner/viscosity of yellow toner)≈0.15,
(viscosity of clear toner/viscosity of magenta toner)≈0.13,
(viscosity of clear toner/viscosity of cyan toner)≈0.22, and
(viscosity of clear toner/viscosity of black toner)≈0.14.

Using the above-described clear and color toners, a gloss evaluation is performed in the same manner as in Example 1. The gloss contrasts on the yellow, magenta, cyan and black toner solid images are measured to be 31, 27, 22 and 29, respectively. On each color toner solid image, the gloss contrast is not less than 15, so the level of the gloss contrast is evaluated as being "excellent," which shows that a print result with an excellent gloss contrast can be obtained.

Furthermore, using the above-described clear toner, the fixation quality is evaluated in the same manner as in Example 2. The temperature difference stands at 38° C., and the level of the fixation quality is evaluated as being "excellent." Moreover, using the above-described clear toner, the storability is evaluated in the same manner as in Example 2. The level of the storability is evaluated as being "excellent."

Comparative Example 4

In Comparative Example 4, a clear toner is produced in the same manner as in Example 2, except that: ester wax (WEP-4, manufactured by NOF Corporation, whose melting point is 71° C.) is instead used as the wax; and the amount of ester wax to be added is set at 38 weight parts. The wax weight ratio in the clear toner is calculated as 38/(1090+38)×100≈3.4 wt %. Tg and the viscosity of the clear toner are 70° C. and 1506 Pa·s, respectively. For the print quality evaluation, Comparative Example 4 uses the color toners which have the same viscosity values as the color toners used in Example 1. The viscosity ratio of the clear toner to each color toner is as follows:

(viscosity of clear toner/viscosity of yellow toner)≈0.43,
(viscosity of clear toner/viscosity of magenta toner)≈0.38,
(viscosity of clear toner/viscosity of cyan toner)≈0.62, and
(viscosity of clear toner/viscosity of black toner)≈0.41.

Using the above-described clear and color toners, a gloss evaluation is performed in the same manner as in Example 1. The gloss contrasts on the yellow, magenta, cyan and black toner solid images are measured to be 17, 12, 10 and 19, respectively. On each of the yellow and black toner solid images, the level of the gloss contrast is evaluated as being "excellent." On each of the magenta and cyan toner solid images, the level of the gloss contrast is evaluated as being "good."

Furthermore, using the above-described clear toner, the fixation quality is evaluated in the same manner as in Example 2. The temperature difference stands at 20° C., and the level of the fixation quality is evaluated as being "bad." Moreover, using the above-described clear toner, the storability is evaluated in the same manner as in Example 2. The level of the storability is evaluated as being "excellent."

Comparative Example 5

In Comparative Example 5, a clear toner is produced in the same manner as in Example 2, except that: paraffin wax (PARACOHOL-6150, manufactured by Nippon Seiro Co., Ltd., whose melting point is 67° C.) is instead used as the wax; and the amount of paraffin wax to be added is set at 38 weight parts. The wax weight ratio in the clear toner is calculated as 38/(1090+38)×100≈3.4 wt %. Tg and the viscosity of the clear toner are 70° C. and 1005 Pa·s, respectively. For the print quality evaluation, Comparative Example 5 uses the color toners which have the same viscosity values as the color toners used in Example 1. The viscosity ratio of the clear toner to each color toner is as follows:

(viscosity of clear toner/viscosity of yellow toner)≈0.29,
(viscosity of clear toner/viscosity of magenta toner)≈0.25,
(viscosity of clear toner/viscosity of cyan toner)≈0.41, and
(viscosity of clear toner/viscosity of black toner)≈0.28.

Using the above-described clear and color toners, a gloss evaluation is performed in the same manner as in Example 1. The gloss contrasts on the yellow, magenta, cyan and black toner solid images are measured to be 21, 16, 15 and 23, respectively. On each color toner solid image, the gloss contrast is 15 or more, the level of the gloss contrast is evaluated as being "excellent," which shows that a print result with an excellent gloss contrast can be obtained from each color toner.

Furthermore, using the above-described clear toner, the fixation quality is evaluated in the same manner as in Example 2. The temperature difference stands at 20° C., and the level of the fixation quality is evaluated as being "bad." Moreover, using the above-described clear toner, the storability is evaluated in the same manner as in Example 2. The level of the storability is evaluated as being "excellent."

Comparative Example 6

In Comparative Example 6, a clear toner is produced in the same manner as in Example 2, except that paraffin wax (PARACOHOL-6150, manufactured by Nippon Seiro Co., Ltd., whose melting point is 67° C.) is instead used as the wax. The wax weight ratio in the clear toner is calculated as 56/(1090+56)×100≈4.9 wt %. Tg and the viscosity of the clear toner are 70° C. and 982 Pa·s, respectively. For the print quality evaluation, Comparative Example 6 uses the color toners which have the same viscosity values as the color toners used in Example 1. The viscosity ratio of the clear toner to each color toner is as follows:

(viscosity of clear toner/viscosity of yellow toner)≈0.28,
(viscosity of clear toner/viscosity of magenta toner)≈0.25,
(viscosity of clear toner/viscosity of cyan toner)≈0.41, and
(viscosity of clear toner/viscosity of black toner)≈0.27.

Using the above-described clear and color toners, a gloss evaluation is performed in the same manner as in Example 1. The gloss contrasts on the yellow, magenta, cyan and black toner solid images are measured to be 24, 20, 16 and 24, respectively. On each color toner, the gloss contrast is not less than 15, so the level of the gloss contrast is evaluated as being "excellent," which shows that a print result with an excellent gloss contrast can be obtained from each color toner.

Furthermore, using the above-described clear toner, the fixation quality is evaluated in the same manner as in Example 2. The temperature difference stands at 30° C., and the level of the fixation quality is evaluated as being "good." In other words, better fixation quality can be obtained from Comparative Example 6 than from Comparative Examples 4, 5. Meanwhile, the temperature difference is narrower by approximately 5° C. in Comparative Example 6 than in Example 2 where the same amount of wax is added. Moreover, using the above-described clear toner, the storability is evaluated in the same manner as in Example 2. The level of the storability is evaluated as being "excellent."

Comparative Example 7

In Comparative Example 7, a clear toner is produced in the same manner as in Example 4, except that Tg and T1/2 of the used polyester resin are 56° C. and 97° C., respectively. The wax weight ratio in the clear toner is calculated as 84/(1090+84)×100≈7.2 wt %. Tg and the viscosity of the clear toner are 61° C. and 220 Pa·s, respectively. For the print quality evaluation, Comparative Example 7 uses the color toners which have the same viscosity values as the color toners used in Example 1. The viscosity ratio of the clear toner to each color toner is as follows:

(viscosity of clear toner/viscosity of yellow toner)≈0.06,
(viscosity of clear toner/viscosity of magenta toner)≈0.06,
(viscosity of clear toner/viscosity of cyan toner)≈0.09, and
(viscosity of clear toner/viscosity of black toner)≈0.06.

Using the above-described clear and color toners, a gloss evaluation is performed in the same manner as in Example 1. The gloss contrasts on the yellow, magenta, cyan and black toner solid images are measured to be 35, 32, 26 and 34, respectively. On each color toner solid image, the gloss contrast is not less than 15, so the level of the gloss contrast is evaluated as being "excellent," which shows that a print result with an excellent gloss contrast can be obtained.

Furthermore, using the above-described clear toner, the fixation quality is evaluated in the same manner as in Example 2. The temperature difference stands at 36° C., and the level of the fixation quality is evaluated as being "excellent." Moreover, using the above-described clear toner, the storability is evaluated in the same manner as in Example 2. The total weight of the weights placed on the column-shaped pile of clear toner stands at 300 grams when the pile of clear toner collapses, and the level of the storability is evaluated as being "bad." The reason for the "bad" result of the storability evaluation in this comparative example is that: Tg of the polyester resin used for this comparative example is as low as 56° C. compared with Tg of any of the polyester resins used for the examples and the other comparative examples; and accordingly, part of the polyester resin melts and toner particles stick to one another in the environment at a storability evaluation temperature of 50° C.

Table 2 shows the results of the evaluations for Examples 2 to 4 and Comparative Examples 4 to 7 discussed above. It should be noted that for each of the examples and the comparative examples, the "Gloss" column in Table 2 registers the worst one among the levels of gloss respectively evaluated for the yellow, magenta, cyan and black toner images. Furthermore, for each of the examples and the comparative examples, the "Overall" column registers an overall judgment level which represents the worst one among the level of gloss registered in the "Gloss" column, the level of fixation quality registered in the "Fixation Quality" column, and the level of storability registered in the "Storability" column.

TABLE 2

| | Polyester Resin | | Wax | | | Clear Toner | | Color Toners | | | | Viscosity Ratios | | | |
|---|---|---|---|---|---|---|---|---|---|---|---|---|---|---|---|
| | Tg | T½ | Type | Melting point | Amount Added [wt %] | Tg | CL Viscosity [Pa · s] | Y Viscosity [Pa · s] | M Viscosity [Pa · s] | C Viscosity [Pa · s] | K Viscosity [Pa · s] | CL/Y | CL/M | CL/C | CL/K |
| Example 2 | 68 | 115 | Paraffin | 62 | 4.9 | 70 | 638 | 3504 | 3962 | 2422 | 3650 | 0.18 | 0.16 | 0.26 | 0.17 |
| Example 3 | ↑ | ↑ | ↑ | ↑ | 7.2 | 70 | 617 | ↑ | ↑ | ↑ | ↑ | 0.18 | 0.16 | 0.25 | 0.17 |
| Example 4 | 62 | 101 | ↑ | ↑ | ↑ | 66 | 525 | ↑ | ↑ | ↑ | ↑ | 0.15 | 0.13 | 0.22 | 0.14 |
| Comparative Example 4 | 68 | 115 | Ester | 71 | 3.4 | 70 | 1506 | ↑ | ↑ | ↑ | ↑ | 0.43 | 0.38 | 0.62 | 0.41 |
| Comparative Example 5 | ↑ | ↑ | Paraffin | 67 | 3.4 | 70 | 1005 | ↑ | ↑ | ↑ | ↑ | 0.29 | 0.25 | 0.41 | 0.28 |
| Comparative Example 6 | ↑ | ↑ | ↑ | ↑ | 4.9 | 70 | 982 | ↑ | ↑ | ↑ | ↑ | 0.28 | 0.25 | 0.41 | 0.27 |
| Comparative Example 7 | 56 | 97 | Paraffin | 62 | 7.2 | 61 | 220 | ↑ | ↑ | ↑ | ↑ | 0.06 | 0.06 | 0.09 | 0.06 |

| | Gloss Contrasts | | | | Temperature | | | | |
|---|---|---|---|---|---|---|---|---|---|
| | CL-Y | CL-M | CL-C | CL-K | Difference | Gloss | Fixation | Storability | Overall |
| Example 2 | 26 | 21 | 18 | 28 | 35 | ○ | ○ | ○ | ○ |
| Example 3 | 27 | 22 | 19 | 29 | 40 | ○ | ○ | ○ | ○ |
| Example 4 | 31 | 27 | 22 | 29 | 38 | ○ | ○ | ○ | ○ |
| Comparative Example 4 | 17 | 12 | 10 | 19 | 20 | Δ | x | ○ | x |
| Comparative Example 5 | 21 | 16 | 15 | 23 | 20 | ○ | x | ○ | x |
| Comparative Example 6 | 24 | 20 | 16 | 24 | 30 | ○ | Δ | ○ | Δ |
| Comparative Example 7 | 35 | 32 | 26 | 34 | 36 | ○ | ○ | x | x |

From the results of the evaluations for Examples 1 to 4 and Comparative Examples 1 to 7 discussed above, it is learned that the gloss contrast becomes larger as the viscosity ratio of the clear toner to each color toner becomes smaller. It is further learned that a viscosity ratio of 0.43 or less can bring about good gloss contrast. Moreover, it is learned that a viscosity ratio of 0.29 or less brings about excellent gloss contrast.

On the other hand, a smaller toner viscosity increases the risk of melting during the storage, and decreases the toner storability. With this taken into consideration, it is desirable that the viscosity of the clear toner be not less than 525 Pa·s. Furthermore, it is desirable that the viscosity ratio of the clear toner to each color toner be not less than 0.13.

In addition, a viscosity ratio of 0.13 or less decreases the viscosity of the clear toner relative to the viscosity of each color toner, and makes it difficult for the clear toner to stay on the color toner. For this reason, it is desirable that the viscosity ratio be set at not less than 0.13 in order to obtain a high gloss and enhance the image quality.

With the gloss and fixation quality taken into consideration, the results in Examples 2 to 4 and Comparative Examples 4 to 7 suggest that a more desirable range of the viscosity ratio is a range of not less than 0.13 and not greater than 0.26.

Furthermore, from the results in Examples 2 to 4 and Comparative Examples 4 to 7, it is learned that: a smaller wax weight ratio tends to make the temperature difference suitable for the fixation become narrower; and a wax weight ratio of 4.9 wt % or more brings about a good fixation quality. One may consider that: a smaller amount of added wax makes the hot offset more likely to occur, and accordingly narrows the temperature difference within which a good fixation quality can be obtained.

On the other hand, a larger amount of added wax makes the wax more likely to be exposed to the toner surface, and the adherence of the exposed wax to the photosensitive drums accordingly makes a phenomenon termed as filming more likely to occur. None of the clear toners of Examples 1 to 4 and Comparative Examples 1 to 7 causes the filming. With this taken into consideration, it is desirable that the wax weight ratio be not greater than 7.2 wt %.

It should be noted that: the toner production method is not limited to what is described above; and the above-described effects can be similarly obtained even from toners produced with other production methods, as long as such toners satisfy the above-described conditions. For example, as long as the viscosity ratio of the clear toner to any color toner satisfies the above-described condition, a good gloss contrast can be obtained.

Furthermore, the invention is not limited to the foregoing embodiment. The invention can be carried out in various modes within the scope without departing from the gist of the invention. For example, although the printer is used as the example of the image formation apparatus in the foregoing embodiment, the invention is applicable to image formation apparatuses of other types such as copiers, facsimile machines and multifunction peripherals combining the above.

Moreover, although the toner including no colorants is used as the example of the transparent developer in the foregoing descriptions, the transparent developer is not limited to this, and may include a small amount of a colorant. Even a toner to which a small amount of a pigment is added can be used as the transparent developer, as long as such a toner exerts the same functions and characteristics as the clear toner of the foregoing embodiment.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus to form an image by using a color developer and a transparent developer, the image formation apparatus comprising:

a first developer container containing the color developer therein;

a second developer container containing the transparent developer therein;

a first development device that forms a color developer image by developing with the color developer a first latent image formed on a first image carrier; and a second development device that forms a transparent developer image by developing with the transparent developer a second latent image formed on a second image carrier, wherein a ratio of a viscosity of the transparent developer at 120° C. to a viscosity of the color developer at 120° C. is not greater than 0.41, and wherein the transparent developer includes polyester resin as a binder resin, and the polyester resin comprises a long chain alkyl group which is expressed by Chemical Formula (1) given below:

[Chemical Formula 1]

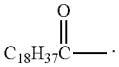

(1)

2. The image formation apparatus according to claim 1, wherein the ratio of the viscosity of the transparent developer to the viscosity of the color developer is not less than 0.13.

3. The image formation apparatus according to claim 1, wherein the viscosity of the transparent developer is not less than 525 Pa·s.

4. The image formation apparatus according to claim 1, wherein the color developer includes polyester resin as a binder resin.

5. The image formation apparatus according to claim 1, wherein the transparent developer includes the binder resin and a release agent, and a ratio of a weight of the release agent to a total of a weight of the binder resin and the weight of the release agent is not less than 4.9 wt % and not greater than 7.2 wt %.

6. The image formation apparatus according to claim 1, wherein the transparent developer includes paraffin wax as a release agent.

7. The image formation apparatus according to claim 1, wherein a ratio of the viscosity of the transparent developer to the viscosity of the color developer is not less than 0.13 and not greater than 0.26.

8. The image formation apparatus according to claim 1, wherein the ratio of the viscosity of the transparent developer at 120° C. to the viscosity of the color developer at 120° C. is not less than 0.13 and not greater than 0.26, a glass transition temperature of the transparent developer is not less than 66° C. and not greater than 70° C., a melting temperature of the binder resin in the transparent developer determined using a bisection method is not less than 101° C. and not greater than 115° C., and the viscosity of the transparent developer is not less than 525 Pa·s and not greater than 638 Pa·s.

* * * * *